US006578799B1

(12) United States Patent
Brushwood

(10) Patent No.: US 6,578,799 B1
(45) Date of Patent: Jun. 17, 2003

(54) MODULAR POINT DETECTOR FOR RAILROAD TRACK SIGNAL

(75) Inventor: Daniel Brushwood, Saluda, SC (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 10/006,506

(22) Filed: Dec. 6, 2001

(51) Int. Cl.[7] ..... B61L 5/00
(52) U.S. Cl. ..... 246/220; 246/476
(58) Field of Search ..... 246/220, 219, 246/218, 260, 476, 401, 253, 448

(56) References Cited

U.S. PATENT DOCUMENTS 3,679,895 A 7/1972 Palve
4,842,225 A 6/1989 Carmes
5,806,809 A * 9/1998 Danner ..... 246/220
6,062,514 A 5/2000 McQuistian
6,164,600 A * 12/2000 Seidl et al. ..... 246/220
6,186,448 B1 2/2001 Wydotis et al.
6,296,208 B1 * 10/2001 Franke ..... 246/220

* cited by examiner

*Primary Examiner*—Mark T. Le
(74) *Attorney, Agent, or Firm*—Brij K. Agarwal; Eckert Seamans Cherin & Mellott, LLC

(57) ABSTRACT

A modular sensor apparatus for detecting the location of a movable track point includes a primary sensor and a secondary sensor disposed on a sensor mount that is movable with respect to a frame that is mounted on a switch machine. The secondary sensor is offset from the primary sensor in order to permit the secondary sensor to detect the need for imminent readjustment of the track point prior to the time at which the track point becomes maladjusted and in need of immediate readjustment. The sensor mount is threadably adjustable with respect to the frame, whereby once the primary sensor has detected the position of the movable track point when it is disposed against a fixed stock rail, the sensor mount can be moved a fixed threshold distance by rotating a thumbwheel a fixed number of turns.

19 Claims, 8 Drawing Sheets

MODULAR POINT DETECTOR FOR RAILROAD TRACK SIGNAL

BACKGROUND OF THE INVENTION

1. Field of the Invention

The present invention relates generally to railroad track switch mechanisms and, more particularly, to a sensor apparatus for sensing the position of a railroad track point.

2. Description of the Related Art

As is known in the relevant art, railroad switch mechanisms are employed between a first set of railroad tracks and an intersecting second set of railroad tracks to selectively switch a train traveling on one of the sets of tracks to the other set of tracks. At the switch mechanism, each pair of track includes a stock rail that is fixed and a movable rail that is selectively movable by the switch mechanism. In this regard, the two movable rails are connected with one another by a bar that permits both movable rails to be simultaneously moved in a single motion of the switch machine. Most switch machines today include an electric motor that performs the switching operation, as well as a backup lever that permits the tracks to be switched manually.

The movable tracks are selectively shifted between a first desirable position and a second desirable position with regard to the fixed stock rails. In the first desirable position, a first movable rail is disposed closely adjacent a first stock rail and the second movable rail is spaced from the second stock rail. In the second desirable position, the second movable rail is disposed closely adjacent the second stock rail, and the first movable rail is spaced from the first stock rail. Each of the movable rails is tapered to a sharp point where it engages the corresponding stock rail in order to provide a smooth transition from the stock rail to the movable rail.

In order to maintain such a smooth transition between the stock rail and the movable rail, it is desired that the movable rail with its tapered end be disposed against the stock rail or at least be disposed closely adjacent the stock rail and typically be spaced no farther than ¼ inch away from the stock rail. If the movable rail is spaced more than ¼ inch away from the stock rail, it is possible for the train wheel rolling along the stock rail to miss the movable rail and continue along the stock rail which can result in a derailment of the train.

In an effort to avoid such a derailment situation, it is known to provide a system for detecting the position of the point of the movable track and to send an appropriate signal depending upon whether the movable track point is within the typical ¼ inch threshold or is outside the threshold and in need of readjustment. For instance, the system may display a green light that can be observed by train personnel if the track point is within the threshold, and alternatively display a red light if the track point is outside the threshold and in need of adjustment. In the latter situation, the train is expected to stop and wait while a railroad worker travels to the switch site and readjusts the movable tracks within the threshold to permit the train to safely pass. While such a delay is costly, it advantageously avoids a train derailment. Previously known point detection systems have not, however, been without limitation. Most such known detection systems have employed mechanical apparatuses such as cam and roller arrangements that were configured to engage certain parts of a specially ground point detector bar that was physically connected with the movable tracks. The cam and roller arrangements would engage special surfaces of the point detector bar when the point detector bar and thus the movable tracks were in specific positions with respect to the stock rails. Such mechanical point detection systems were subject to high levels of wear over time with consequent lost motion and inaccurate position readings. Additionally, in the event that such mechanical detection systems were maladjusted with the cam and roller arrangements being in perpetual engagement with the point detector bar, such maladjustment resulted in accelerated wear due to the vibrations experienced by the system when a train passed over the switch. It thus is known to provide an electronic sensor that is capable of detecting the position of the track point without requiring physical contact between mechanical components.

Such known sensor-based systems have not, however, been without limitations. Due to the high vibrations and the extreme temperature variations of the environment in which such sensor-based systems are used, it is known that the sensitive sensing equipment of such systems periodically requires replacement. Such replacement can be time consuming inasmuch as it can require complex disassembly of the switch machine and painstaking readjustment procedures. It is thus desirable to provide a point detector system that can be easily replaced. It is further desired to provide a sensor system that can readily be readjusted.

Previously known sensor-based systems have been generally effective at indicating that a track point has become maladjusted and impassable thus requiring a train to await readjustment of the track point before proceeding over the switch. Such waiting is costly for the rail company, however. It thus is desirable to additionally provide a sensor-based point detection system that additionally indicates the need for imminent readjustment of a track point prior to the time that the track point actually becomes maladjusted and is in need of immediate readjustment.

SUMMARY OF THE INVENTION

In view of the foregoing, a modular sensor apparatus for detecting the location of a movable track point includes a primary sensor and a secondary sensor disposed on a sensor mount that is movable with respect to a frame that is mounted on a switch machine. The secondary sensor is offset from the primary sensor in order to permit the secondary sensor to detect the need for imminent readjustment of the track point prior to the time at which the track point becomes maladjusted and in need of immediate readjustment. The sensor mount is threadably adjustable with respect to the frame, whereby once the primary sensor has detected the position of the movable track point when it is disposed against a fixed stock rail, the sensor mount can be moved a fixed threshold distance by rotating a thumbwheel a fixed number of turns.

An aspect of the present invention is to provide a sensor apparatus for detecting the location of a movable track point of a movable track of a railroad switch machine.

Another aspect of the present invention is to provide a sensor apparatus that is modular.

Another aspect of the present invention is to provide a sensor apparatus having a primary sensor and a secondary sensor, the secondary sensor being offset from the primary sensor.

Another aspect of the present invention is to provide a sensor apparatus that detects the need for imminent readjustment of a track point prior to the track point becoming maladjusted and requiring immediate readjustment.

Another aspect of the present invention is to provide a sensor apparatus having a threadably adjustable sensor mount that can be adjusted a threshold distance by rotating a threaded member a given number of turns.

BRIEF DESCRIPTION OF THE DRAWINGS

A further understanding of the invention can be gained from the following description of the preferred embodiment when in read in conjunction with the accompanying drawings in which.

Similar numerals refer to similar parts throughout the specification.

DESCRIPTION OF THE PREFERRED EMBODIMENT

Figure 7A:
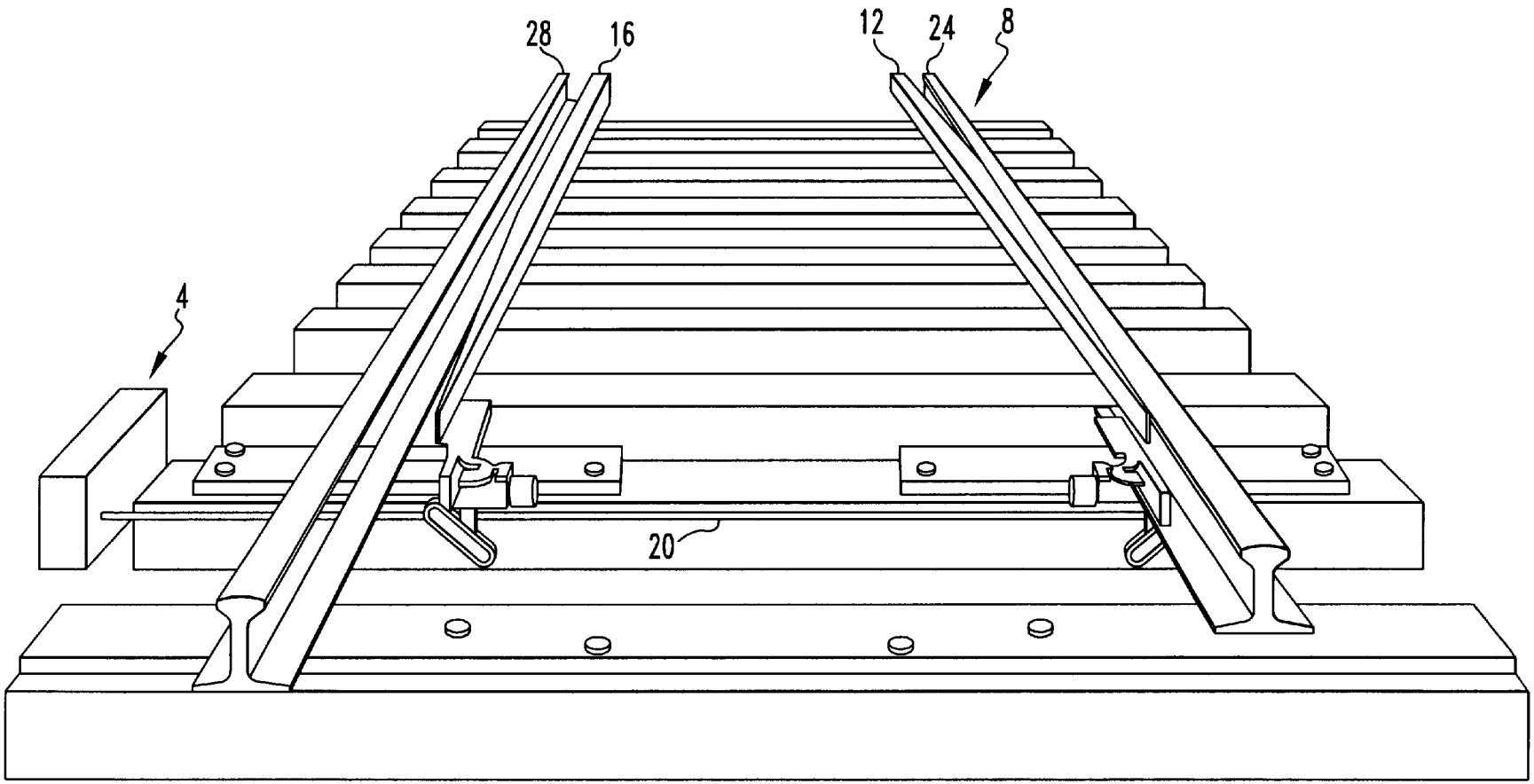
FIG. 7A is a perspective view of a railroad switch including a schematically depicted switch machine connected with a pair of movable tracks in a first position.
Figure 8B:
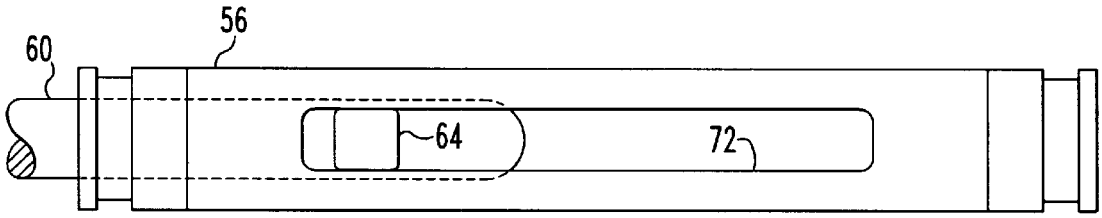
FIG. 8B is a view similar to FIG. 7B, except depicting the target being disposed at a location with respect to the point detector sleeve that reflects the movable tracks being in the second position.
Figure 8A:
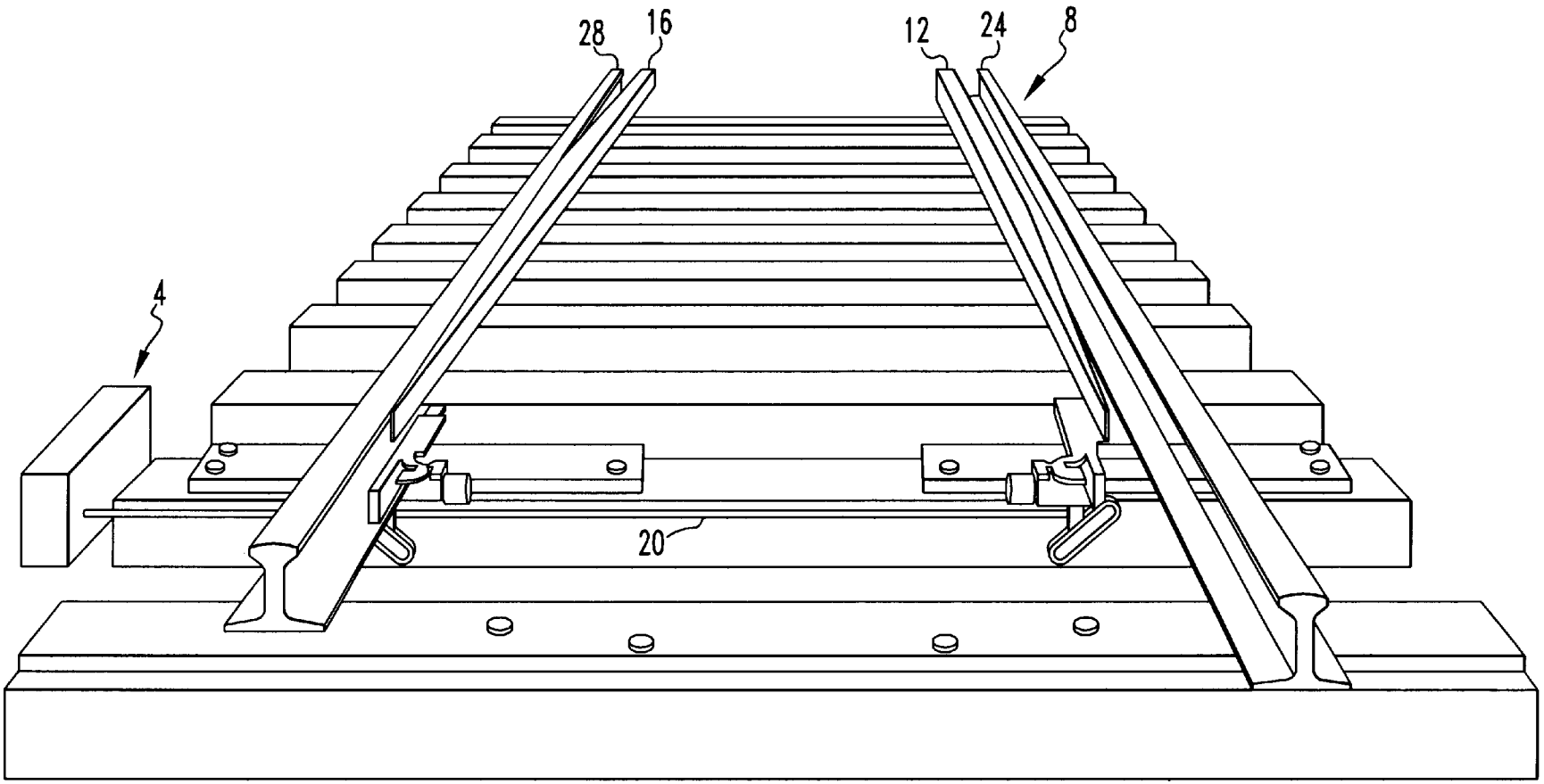
FIG. 8A is a view similar to FIG. 7A, except depicting the movable tracks in a second position.

A switch machine 4 in accordance with the present invention is schematically depicted in FIGS. 7A and 8A as being operatively connected with a railroad switch 8 to switch a train (not shown) between a first set of railroad tracks and a second set of railroad tracks in a known fashion.

As can be seen in FIGS. 7A and 8A, the railroad switch 8 includes a first movable track 12 and a second movable track 16 that are movably connected with one another via a head rod 20 extending therebetween. The railroad switch 8 further includes a first stock rail 24 and a second stock rail 28 that are substantially fixed and immovable. As is known in the relevant art, the switch machine 4 is configured to move the first and second movable tracks 12 and 16 between a first position (FIG. 7A) and a second position (FIG. 8A). When the first and second movable tracks 12 and 16 are in the first position, the first movable track 12 is engaged with or is disposed closely adjacent the first stock rail 24, and the second movable track 16 is spaced from the second stock rail 28. When the first and second movable tracks 12 and 16 are in the second position, the second movable track is engaged with or is disposed closely adjacent the second stock rail 28, and the first movable track 12 is spaced from the first stock rail 24. The first and second movable tracks 12 and 16 are each tapered to a sharp track point to provide a smooth transition from the first and second stock rails 24 and 28.

In addition to including a power apparatus that provides the motile force to move the first and second movable tracks 12 and 16 between the first and second positions, the switch machine 4 includes a position sensing system 32 for detecting the position of the first and second movable tracks 12 and 16 with respect to the first and second stock rails 24 and 28 as well as a retention system (not shown) for retaining the first and second movable tracks 12 and 16 in one of the first and second positions. With particular regard to the position sensing system 32, it is desired that the first and second movable tracks 12 and 16 tightly engage the first and second stock rails 24 and 28 when the first and second movable tracks 12 and 16 are in the first and second positions in order to ensure the smooth transition of the train from the first and second stock rails 24 and 28 to the first and second movable tracks 12 and 16, as the case may be, without a derailment. Due to the effects of mechanical wear, maladjustment, and foreign debris such as stones and ice being interposed between the first and second movable tracks 12 and 16 and the first and second stock rails 24 and 28, it is possible for the movable tracks to be disposed closely adjacent the stock rails without being physically engaged therewith. If the movable racks are spaced too far from the stock rails, however, a derailment of the train may result. The position sensing system 32 thus is configured to generate an alarm signal when the first or second movable track 12 or 16, as appropriate, is spaced beyond the predetermined threshold from its corresponding stock rail. The typical threshold distance is ¼ inch, although in some circumstances it maybe ⅜ inch.

The position sensing system 32 includes a support 36, a rod apparatus 40 that is physically connected with or linked with the first and second movable tracks 12 and 16, and a detection mechanism 44 that is includes a first sensor apparatus 48 and second sensor apparatus 52. As will be set forth more fully below, a portion of the rod apparatus 40 moves in conjunction with the first and second movable tracks 12 and 16 and thus provides an indication of the position of the first and second movable tracks 12 and 16 that can be detected by the first and second sensor apparatuses 48 and 52.

The rod apparatus 40 includes a point detector sleeve 56, a point detector bar 60 that telescopes within the point detector sleeve, and a target 64 mounted on the point detector bar 60. More specifically, the point detector sleeve 56 is a substantially cylindrical member having an arcuate outer surface and being formed with a substantially cylindrical bore 68 extending throughout the longitudinal extent of the point detector sleeve 56. The point detector sleeve 56 is additionally formed with a slot 72 extending along a portion of the arcuate outer surface and in communication with the bore 68. The point detector sleeve 56 is mounted on a first cap 76 and a second cap 80 that are, in turn, mounted on a first ear 84 and a second ear 88 of the support 36. The point detector sleeve 56 is thus fixedly mounted on the support 36.

The point detector bar 60 is an elongated substantially cylindrical member that is sized to telescope within the bore 68 of the point detector sleeve 56. The point detector bar 60 extends through an opening formed in the first cap 76 and is connected via a connection bar (not specifically shown) with the first and second movable tracks 12 and 16.

The target 64 is fixedly mounted on the point detector bar 60 with a screw 92. The target 64 is configured to remain disposed within the slot 72 while the point detector bar 60 telescopes within the bore 68 of the point detector sleeve 56. The target 64 is mounted on the point detector bar 60 by initially receiving a portion of the point detector bar 60 into the bore 68 and receiving the screw 92 through an insertion opening (not shown) formed in the point detector sleeve 56 opposite the slot 72. The screw 92 is then received through a cross-bore 94 formed in the point detector bar 60 and is threadably received in a correspondingly threaded hole formed in the target 64.

It can be seen that the position of the target 64 within the slot 72 is directly indicative of the position of the first and second movable tracks 12 and 16 with respect to the first and second stock rails 24 and 28. The first and second sensor apparatuses 48 and 52 are configured to sense the proximity of the target 64 in order to detect the position of the first and second movable tracks 12 and 16, as will be set forth more fully below.

The first and second sensor apparatuses 48 and 52 are modular in nature, meaning that they each exist as a complete assembly of components that can be readily installed into and removed from the support 36 as a unit. Inasmuch as the first and second sensor apparatuses 48 and 52 are substantially structurally identical, only the first sensor apparatus 48 will be described in detail herein. As will be set forth more fully below, the first sensor apparatus 48 is provided to detect the proximity of the first movable track 12 to the first stock rail 24, and the second stock rail 28 is provided to detect the proximity of the second movable track 16 to the second stock rail 28.

Figure 3:
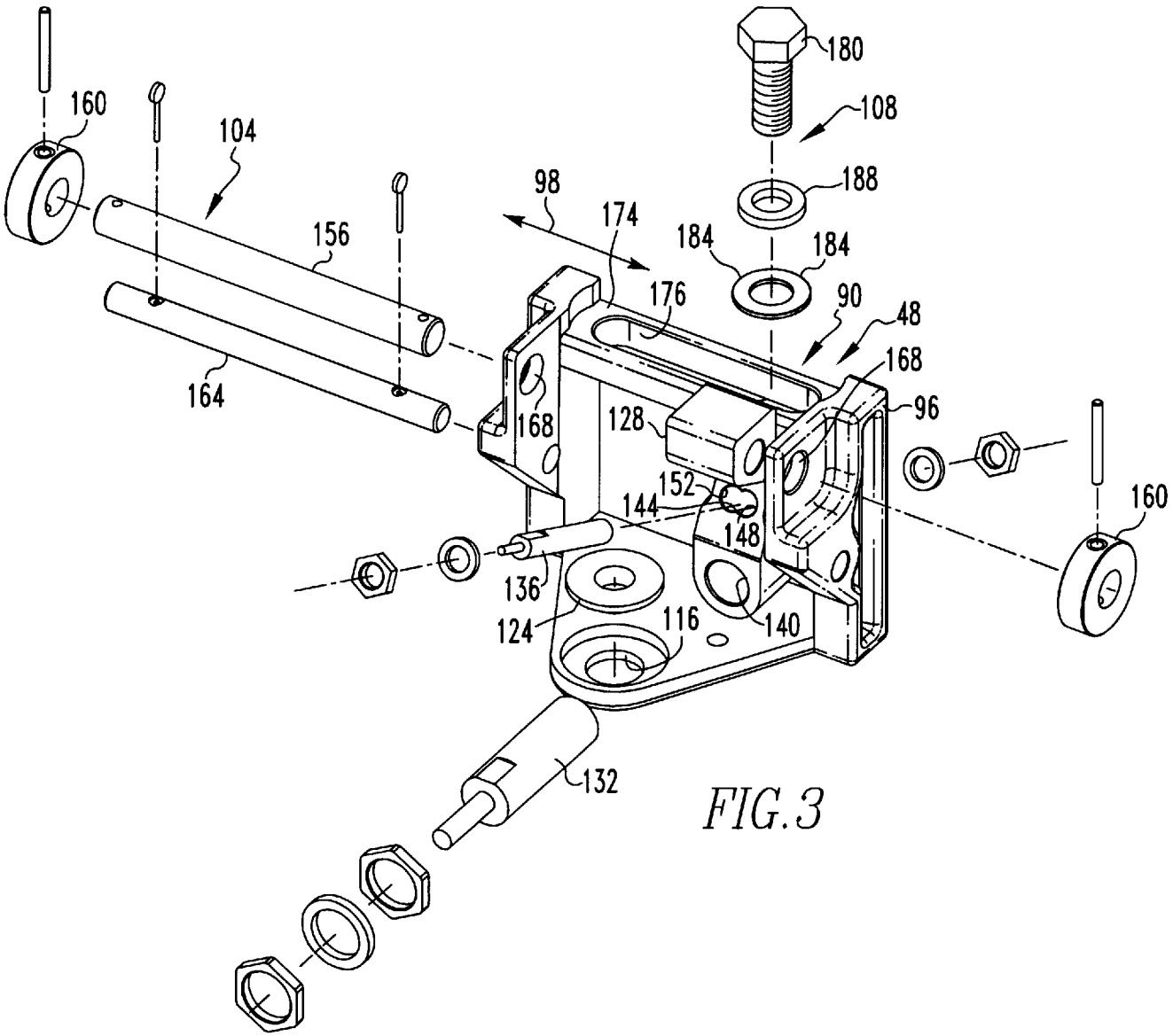
FIG. 3 is an exploded view of one of the sensor apparatuses of FIG. 1.

As can best be seen in FIG. 3, the first sensor apparatus 48 includes a frame assembly 90, a primary sensor 132, and a secondary sensor 136. The frame assembly 90 includes a frame 96 and an upper plate 174. The frame assembly 90 further includes an adjustment apparatus 104 and a sensor mount 128 disposed on the frame 96, and a locking apparatus 108 disposed on the upper plate 174.

Figure 1:
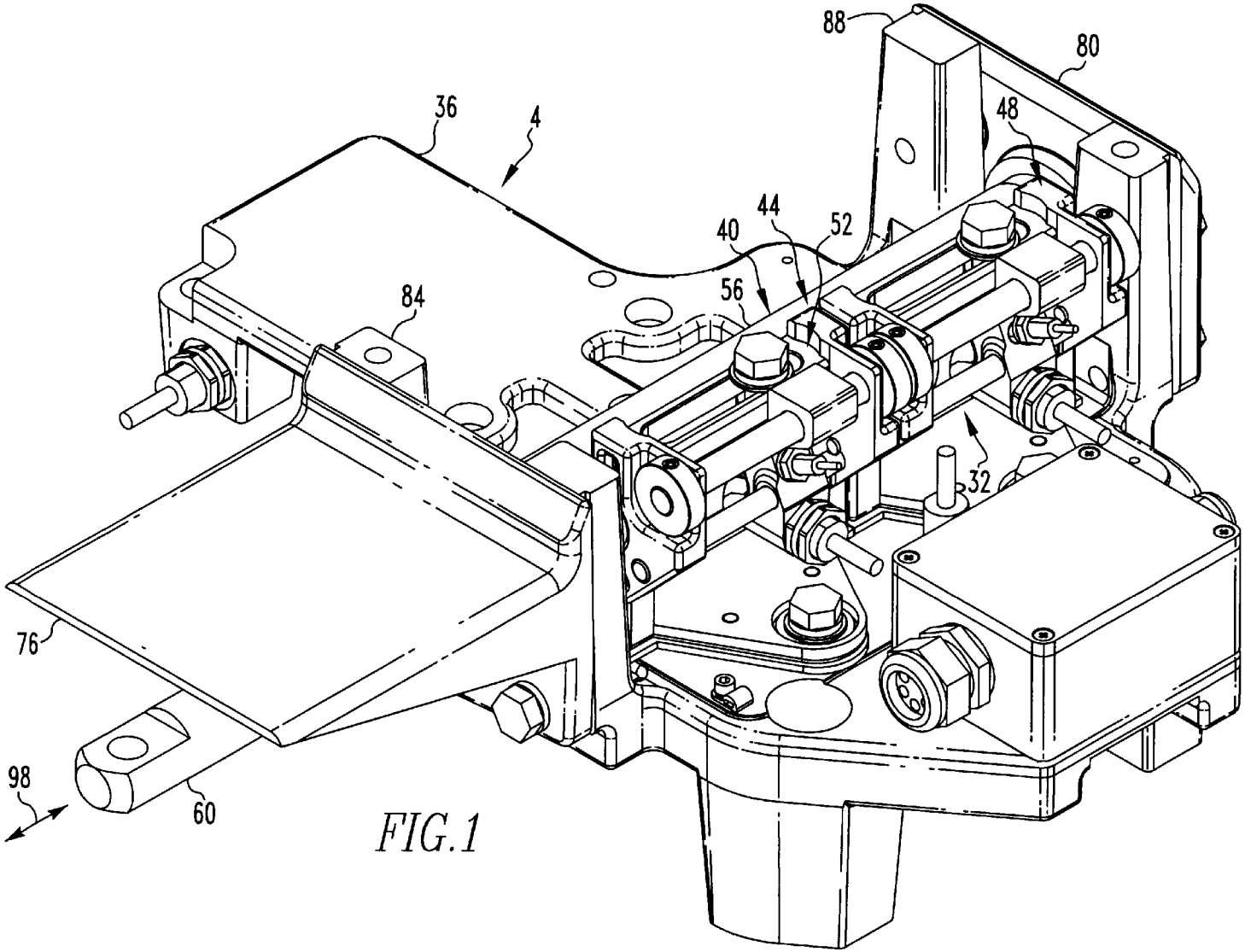
FIG. 1 is a perspective view of a portion of a switch machine that incorporates a pair of sensor apparatuses in accordance with the present invention.
Figure 2:
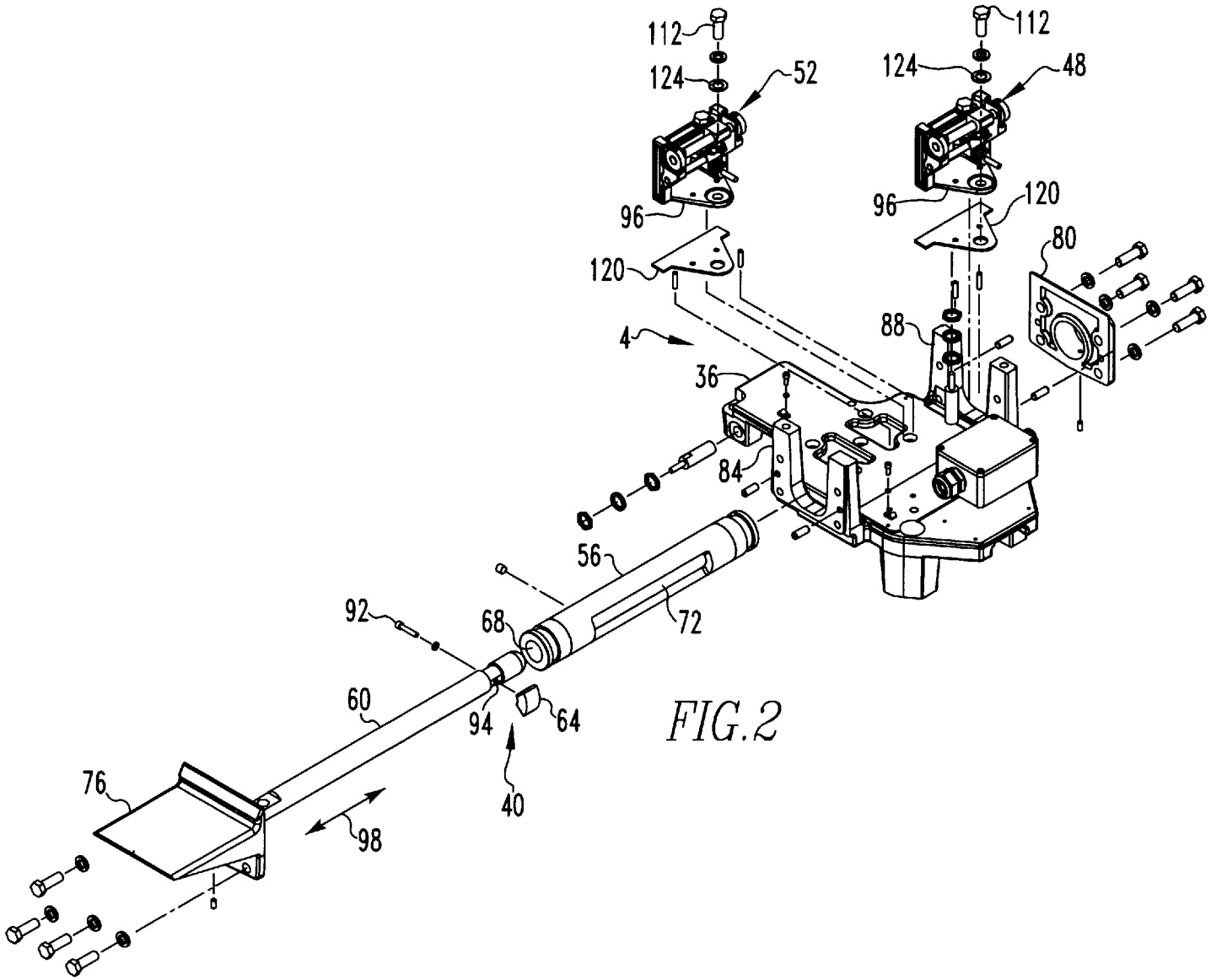
FIG. 2 is an exploded version of FIG. 1.

The frame 96 is formed with an attachment hole 116 that is counterbored to permit the frame 96 and thus the first sensor apparatus 48 to be fixedly mounted on the support 36 with a bolt 112 (FIG. 2.) An insulation sheet 120 (FIG. 2) is interposed between the support 36 and the frame 96, and an insulating washer 124 (FIGS. 2 and 3) is disposed in the counterbore of the attachment hole 116 and is interposed between the frame 96 and the head of the bolt 112. The insulation sheet 120 and insulating washer 124 electrically isolate the first sensor apparatus 48 from the support 36 which advantageously reduces the likelihood that the first sensor apparatus 48 will be burned out in the event of a lightning strike to the switch machine 4. It is understood, however, that other types of insulating structures maybe employed to electrically isolate the first sensor apparatus 48 from the support 36.

As can be understood from FIG. 2, the point detector bar 60 translates along a direction of travel indicated generally by the arrow 98 with respect to the point detector sleeve 56, and the first and second movable tracks 12 and 16 similarly translate along the same direction of travel 98. While it is understood that in moving between the first and second positions the first and second movable tracks 12 and 16 may both simultaneously pivot and translate, the displacement of the first and second movable tracks 12 and 16 as it relates to the telescoping movements of the point detector bar is considered herein to be a translation along the direction of travel that is indicated generally at the numeral 98.

The primary sensor 132 and the secondary sensor 136 are disposed on the sensor mount 128, and the sensor mount 128 is movable with respect to the frame 96. More specifically, the sensor mount is translatable with respect to the frame. The primary sensor 132 is disposed in a primary hole 140 formed in the sensor amount 128, and the secondary sensor 136 is disposed in a mounting hole 144 formed in the sensor mount 128.

As can be seen in FIG. 3, the mounting hole 144 is not cylindrical, but rather is formed by the union of a pair of intersecting parallel cylindrical holes. The mounting hole 144 is thus generally of a figure-8 shape in cross section. The uniquely shaped mounting hole 144 thus includes a first seat 148 and a second seat 152, each of which is defined by one of the cylindrical holes. The secondary sensor 136 advantageously can be disposed in either of the first and second seats 148 and 152 depending upon whether the secondary sensor 136 is being positioned as such for use in the first sensor apparatus 48 that will be employed to detect the position of the target 64 when the first and second movable tracks 12 and 16 are in the first position, or whether the secondary sensor 136 is being positioned for use in the second sensor apparatus 52 that will be employed to detect the position of the target 64 when the first and second movable tracks are in the second position. In this regard, the secondary sensor 136 disposed in the first seat 148 defines a first mounting position, and the secondary sensor 136 disposed in the second seat 152 defines a second mounting position.

Figure 4:
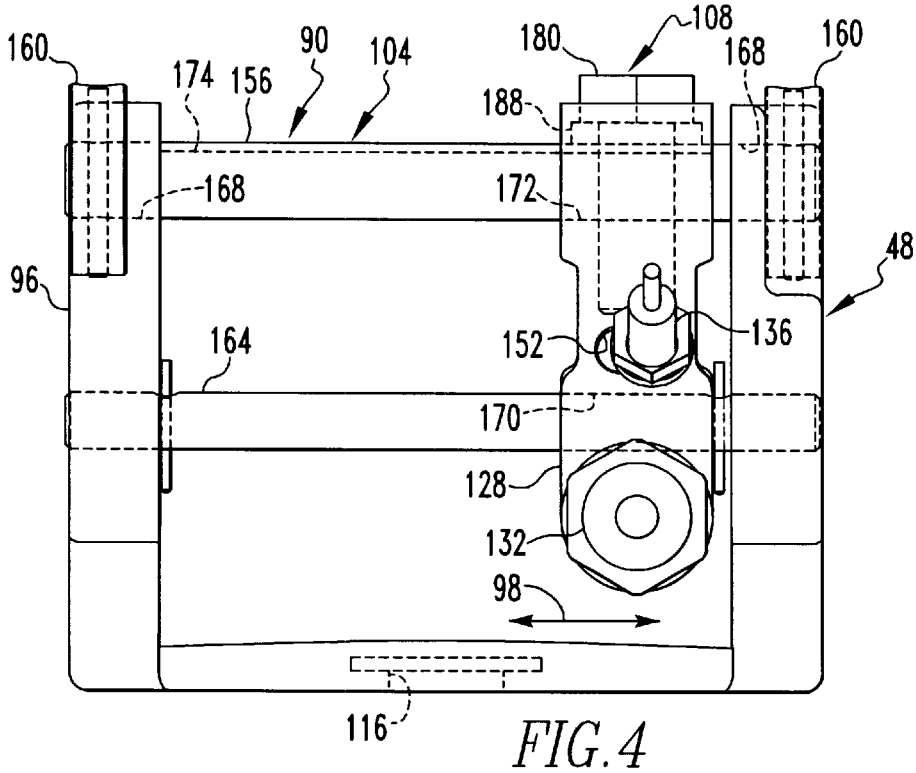
FIG. 4 is a front elevational view of the sensor apparatus of FIG. 3.
Figure 5:
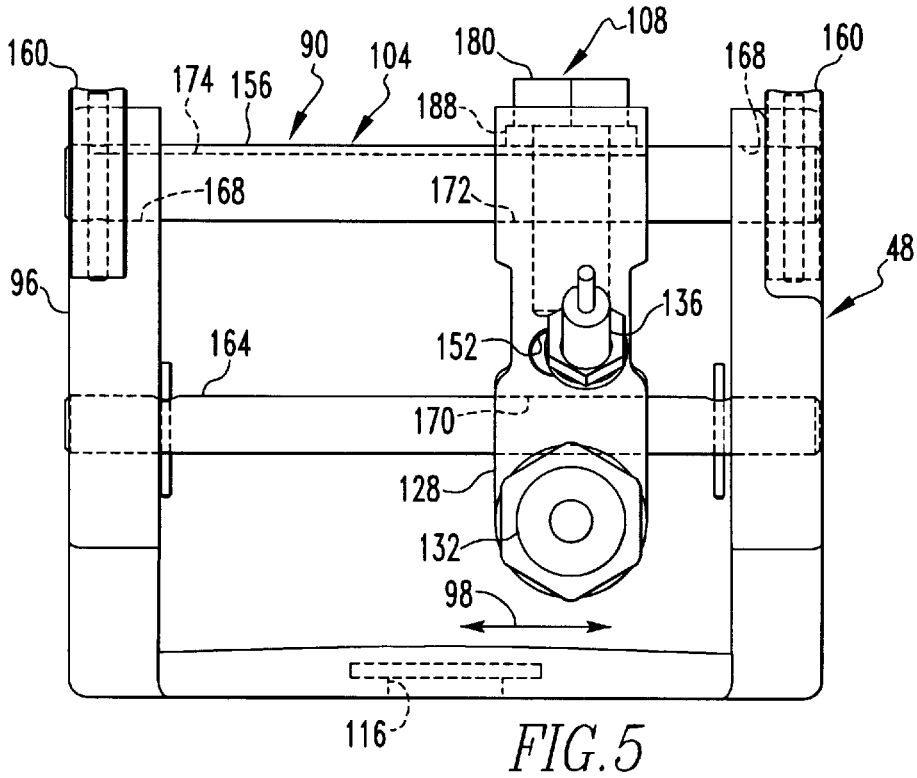
FIG. 5 is a view similar to FIG. 4, except showing a sensor mount of the sensor apparatus spaced to a different position.
Figure 6:
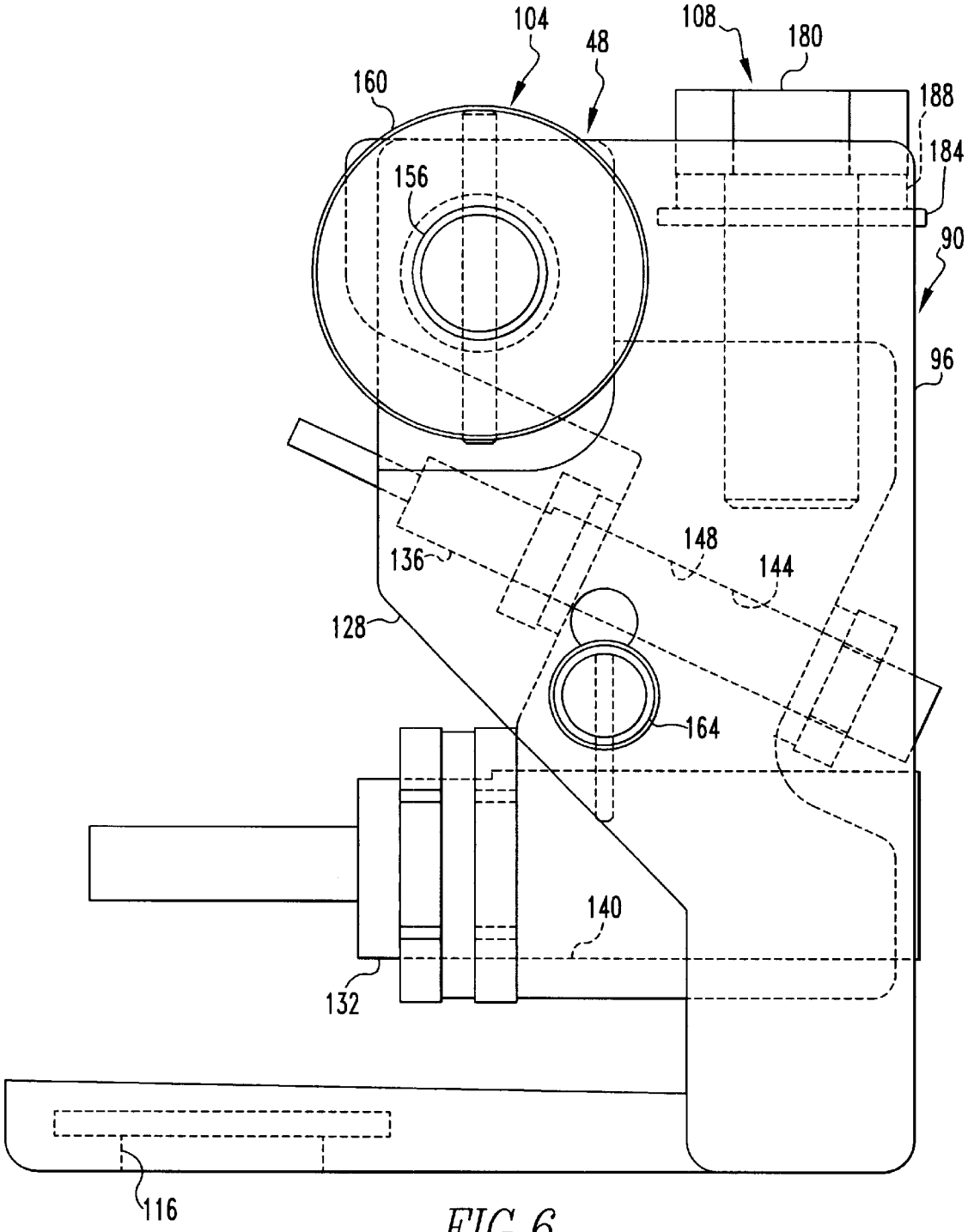
FIG. 6 is a side elevational view of the sensor apparatus of FIG. 3.

As can be understood from FIGS. 4 and 5, the first and second seats 148 and 152 are each slightly offset along the direction of travel 98 from the primary hole 140 and thus from the primary sensor 132. The purpose of such offsetting of the first and second seats 148 and 152 from the primary sensor 132 will be set forth more fully below.

The adjustment apparatus 104 includes a threaded member 156, a pair of thumbwheels 160 mounted at opposite ends of the threaded member 156, and a slide 164 that is fixedly mounted on the frame 96. The threaded member 156 is rotatably disposed in a pair of spaced rotational seats 168 formed on the frame 96. The thumbwheels 160 are fixedly mounted on the threaded member 156 in such a fashion that the frame 96 is interposed between the thumbwheels 160, whereby the threaded member 156 is retained on the frame 96 while permitting rotation of the threaded member 156 and the thumbwheels 160.

The sensor mount 128 is mounted on both the threaded member 156 and the slide 164. More specifically, the threaded member 156 operatively extends through a threaded seat 172 (FIGS. 4 and 5) formed on the sensor mount 128, with the threaded seat 172 being threaded to cooperate threadably with the threaded member 156. As such, rotation of the threaded member 156 and the thumbwheels 160 causes the sensor mount 128 to translate along the direction of travel 98 inasmuch the threaded member 156 and thumbwheels 160 are non-translatably mounted on the frame 96. The slide 164 extends through a slide hole 170 formed in the sensor mount 128 to resist rotation of the sensor mount 128 upon rotation of the thumbwheels 160 and threaded member 156.

As is best shown in FIGS. 2 and 3, the upper plate 174 is formed with an elongated aperture 176 that extends in a direction substantially parallel with the direction of travel 98 (FIG. 2). The locking apparatus 108 includes a bolt 180, a flat washer 184 and a lock washer 188. The bolt 180 can be threaded into a threaded opening (not shown) formed in the sensor mount 128 and can be tightened against the upper plate 174 to lock the sensor mount 128 in a given position with respect to the frame 96. If it is desired to reposition the sensor mount 128, the bolt 180 can be loosened and then retightened after repositioning of the sensor mount 128.

Figure 9:
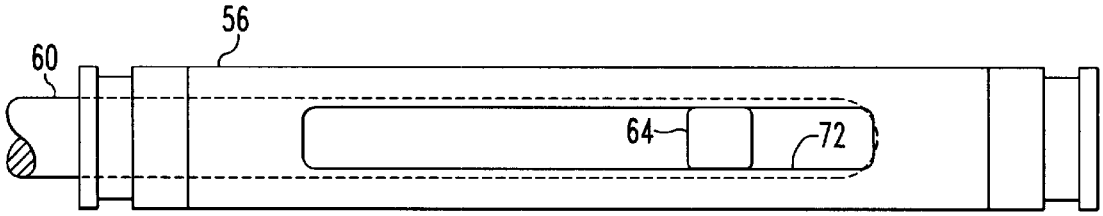
FIG. 9 is a view similar to FIG. 7B, except depicting the target at a threshold position that is spaced from the position of the target that is depicted in FIG. 7B.
Figure 10:
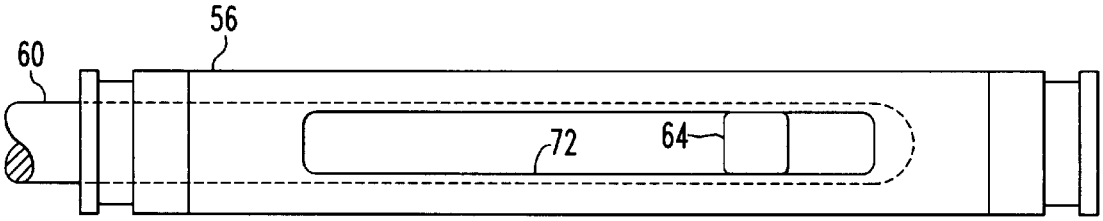
FIG. 10 is a view similar to FIG. 7B, except depicting the target located at a readjustment position disposed between the position of the target depicted in FIG. 7B and the threshold position.

In operation, the first sensor apparatus 48 detects the presence of the target 64 at both a threshold position (FIG. 9) and a readjustment position (FIG. 10) of the target 64 for purposes to be set forth more fully below. Further in this regard, the position of the target 64 when the first and second movable tracks 12 and 16 are in the first position is depicted generally in FIG. 7B, and the position of the target 64 when the first and second movable tracks 12 and 16 are in the second position is indicated generally in FIG. 8B. It is understood that the threshold and readjustment positions of the target 64 depicted generally in FIGS. 9 and 10, respectively, correspond with specific allowable departures or movements of the first and second movable tracks 12 and 16 from the first position depicted generally in FIG. 7A, and that separate threshold and readjustment positions (not shown) of the target 64 exist as to the second position of the first and second movable tracks 12 and 16 (FIG. 8A).

The primary and secondary sensors 132 and 136 are each Hall Effect sensors that are configured to detect the proximity of the target 64 thereto. The primary and secondary sensors 132 and 136 are each connected with additional circuitry that provide various indications to railroad personnel depending upon the signals received from the primary and secondary sensors 132 and 136.

In order to adjust the first sensor apparatus 48, the first and second movable tracks 12 and 16 are carefully positioned in the first position such that the first movable track 12 is tightly disposed against the first stock rail 28. The thumbwheels 160 are then rotated to translate the sensor mount 128 until the primary sensor 136 detects the presence of the target 64. Such a position of the sensor mount 128 is depicted generally in FIG. 4. Depending upon the specific configuration of the target 64, the sensor mount 128 likely will be adjusted to the point at which it begins to sense the leading edge of the target 64.

Once the sensor mount 128 has been adjusted to detect the target 64 in the first position in the aforementioned fashion, the position of one of the thumbwheels 160 is noted and the thumbwheel 160 is then rotated a specific number of rotations in order to translate the sensor mount 128 by the threshold distance along the direction of travel 98. Such a position of the sensor mount 128 is indicated generally in FIG. 5. In this regard, the threaded member 156 is threaded in a known fashion with a specific number of threads per inch. For instance, if the threaded member 156 is threaded to have twenty threads per inch, each thread will occupy 0.05 inches along the length of the threaded member 156. Correspondingly, each rotation of the threaded member 156 with the thumbwheels 160 results in a translation of the sensor mount 128 by 0.05 inches along the direction of travel 98.

It thus can be seen that if the threshold distance is ¼ inch, a threaded member 156 having twenty threads per inch will need to be rotated five times in order to translate the sensor mount 128 by the ¼ inch threshold distance. Accordingly, it can be seen that by rotating the thumbwheels 160 a given number of turns, the sensor mount 128 can be advantageously translated a precise distance from where (as depicted in FIG. 4) the primary sensor 132 initially detected the target 64 with the first and second movable tracks 12 and 16 in the first position to a location (as is depicted in FIG. 5) where the primary sensor 132 is capable of detecting the target 64 when the first movable track 12 is at the threshold position and is out of adjustment. The bolt 180 is then preferably tightened to lock the sensor mount 128 in the aforementioned position.

By configuring the first sensor apparatus 48 such that the threaded member 156 has a specified number of threads per inch, the sensor mount 128 can be quickly and accurately translated the threshold distance without the need for external measuring devices such as rulers or calipers. Similarly, the only tool required for performing such an adjustment is a wrench or other tool that can loosen and tighten the bolt 180. It is understood that if the threshold distance is other than ¼ inch, the thumbwheels 160 can be rotated a different number of turns and/or the threaded member 156 may be configured to have a different number of threads per inch to simplify the number of rotations required.

The secondary sensor 136 advantageously detects a condition in which the first movable track 12 is at a readjustment position that is disposed between the first position and the threshold position. In this regard, the secondary sensor 136 generates a signal when the target 64 is at the readjustment position (FIG. 10), which accordingly signals to a maintenance worker the need for imminent readjustment of the first and second movable tracks 12 and 16 prior to the first and second movable tracks 12 and 16 actually reaching the threshold position (FIG. 9), at which time readjustment of the first and second movable tracks 12 and 16 would be immediately necessary. In this regard, when the first and second tracks 12 and 16 are undesirably at the threshold position, a warning signal is generated by the switch machine 4 that indicates to railroad personnel that the railroad switch 8 is unsafe to cross, thus requiring a train to wait until the first and second movable tracks 12 and 16 can be readjusted. As such, the advantageous signal provided by the secondary sensor 136 that the first and second movable tracks 12 and 16 are in the readjustment position, which is prior to the first and second movable tracks 12 and 16 reaching the threshold position, a maintenance worker can be alerted to the need for readjustment of the first and second movable tracks 12 and 16 prior to the time at which the first and second movable tracks 12 and 16 become so far out of adjustment that trains are prohibited from traversing the railroad switch 8.

As indicated hereinbefore, the first and second seats 148 and 152 are each offset in opposite directions along the direction of travel 98 from the primary sensor 132. Such an offset from the primary sensor 132 provides the distance between the primary and secondary sensors 132 and 136 which spaces apart their individual detection zones and which permits their detection of the threshold position and the readjustment position, respectively, of the target 64. As such, no additional adjustment needs to be performed after the thumbwheels 160 have been rotated the prescribed number of turns in order to translate the sensor mount 128 to the position depicted generally in FIG. 5. The secondary sensor 136 is offset from the primary sensor 132 a sufficient distance that the secondary sensor 136 will detect the presence of the target 64 prior to the target 64 being detected by the primary sensor 132. The target 64 being detected by the primary sensor 132 would indicate that the first and second movable tracks 12 and 16 have reached the threshold position, requiring immediate readjustment.

Figure 7B:
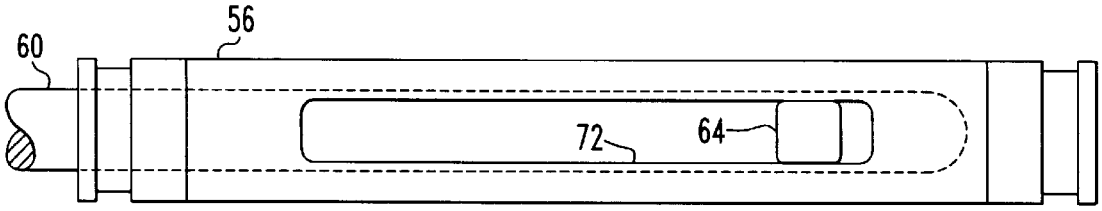
FIG. 7B is a front elevational view of a point detector sleeve and a target of the switch machine, with the position of the target with respect to the point detector sleeve corresponding with the first position of the movable tracks.

It can be seen that as to the first sensor apparatus 48, the secondary sensor 136 is disposed in the first seat 148, which provides an offset of the secondary sensor 136 in a direction from the primary sensor 132 toward the position the target occupied 64 in the first position (FIG. 7B). Similarly, in the second sensor apparatus 52 the secondary sensor 136 is disposed in the second seat 152, which provides an offset in a direction from the primary sail sensor 132 toward the position occupied by the target 64 when in the second position (FIG. 8B). It thus can be seen that by configuring the mounting hole 144 to have both the first and secondary seats 148 and 152 the modular nature of the first sensor apparatus 48 can be maintained, whereby a single component assembly can be used for both the first sensor apparatus 48 and the second sensor apparatus 52, and the only change required therebetween is selecting placement of the secondary sensor 136 in the first or second seats 148 or 152.

Accordingly, the first and second sensor apparatuses 48 and 52 are substantially identical to one another and are modular in nature, which permits expedited removal and installation of each with only rudimentary tools and permits a single apparatus to be used as either of the first and second sensor apparatuses 48 and 52. Additionally, by providing the threaded member 156 with a known thread distribution along its length, the sensor mount 128 can be quickly and accurately translated by the threshold distance by simply rotating the thumbwheels 160 a number of turns and without the need for external measuring devices. Furthermore, the secondary sensor 136 is advantageously provided in an offset position which the presence of the first and second movable tracks 12 and 16 at the readjustment position, which permits indication to railroad maintenance personnel the need for readjustment of the first and second movable tracks 12 and 16 prior to the time at which it would be necessary to make a train wait due to maladjustment of the first and second movable tracks. It is understood that those knowledgeable in the art would perceive additional advantages not specifically disclosed herein.

While a particular embodiment of the present invention has been described herein, it is understood that various changes, additions, modifications, and adaptations may be made without departing from the scope of the present invention, as set forth in the following claims.

What is claimed is:

1. A sensor apparatus for detecting the location of a movable track that is movable along a direction of travel between a first position and a second position, the sensor apparatus comprising:

a frame assembly including a sensor mount and a frame, the sensor mount being movable with respect to the frame;

a primary sensor disposed on the sensor mount, the primary sensor being structured to detect a condition in which the movable track has moved from the first position beyond a threshold position that is spaced from the first position; and a secondary sensor disposed on the sensor mount, the secondary sensor being structured to detect a condition in which the movable track is located at a readjustment position disposed between the first position and the threshold position.

2. The sensor apparatus as set forth in claim 1, in which the secondary sensor is offset from the primary sensor along the direction of travel of the movable track.

3. The sensor apparatus as set forth in claim 2, in which the secondary sensor is mounted on the sensor mount in one of a first mounting position and a second mounting position.

4. The sensor apparatus as set forth in claim 3, in which the first and second mounting positions are defined on a mounting hole formed in the sensor mount.

5. The sensor apparatus as set forth in claim 1, in which the sensor mount is translatable with respect to the frame.

6. The sensor apparatus as set forth in Claim 5, in which the frame assembly includes an adjustment apparatus operatively extending between the frame and the sensor mount.

7. The sensor apparatus as set forth in claim 6, in which the adjustment apparatus includes a threaded member extending between the frame and the sensor mount.

8. The sensor apparatus as set forth in claim 7, in which the threaded member is rotatably disposed on the frame and is threadably cooperable with the sensor mount.

9. The sensor apparatus as set forth in claim 1, in which the frame assembly includes a locking apparatus that locks the sensor mount in a given position with respect to the frame.

10. The sensor apparatus as set forth in claim 9, in which the locking apparatus includes a locking member that is lockably extendable between the frame and the sensor mount.

11. The sensor apparatus as set forth in claim 1, in which the sensor apparatus is modular.

12. The sensor apparatus as set forth in claim 10, in which the locking member is a fastener.

13. The sensor apparatus as set forth in claim 12, in which the sensor mount includes a primary hole formed therein, the primary sensor being receivable in the primary hole.

14. The sensor apparatus as set forth in claim 13, in which the sensor mount includes a mounting hole formed therein, the mounting hole including a first seat and a second seat, the secondary sensor being disposed on one of the first and second seats, and in which the first and second seats are each offset along the direction of travel from the primary hole.

15. The sensor apparatus as set forth in claim 14, in which the first and second seats are each offset substantially the same distance along the direction of travel in opposite directions from the primary hole.

16. An apparatus for detecting a condition in which a movable track is on the verge of moving along a direction of travel outside a threshold region that extends between a desired first position and a threshold position, the apparatus comprising:

means for detecting the presence of the movable track at the threshold position;

means for detecting the presence of the movable track at a readjustment position disposed between the first position and the threshold position; and means for simultaneously moving along the direction of travel the means for detecting the presence of the movable track at the threshold position and the means for detecting the presence of the movable track at the readjustment position.

17. The apparatus as set forth in claim 16, in which the means for detecting the presence of the movable track at the threshold position and the means for detecting the movable track at the readjustment position are offset from one another along the direction of travel.

18. The apparatus as set forth in claim 16, in which the apparats is modular.

19. A sensor apparatus for detecting the location of a movable track that is movable along a direction of travel between a first position and a second position, the sensor apparatus comprising:

a frame assembly including a sensor mount;

a primary sensor disposed on the sensor mount, the primary sensor being structured to detect a condition in which the movable track has moved from the first position beyond a threshold position that is spaced from the first position; and a secondary sensor disposed on the sensor mount, the secondary sensor being structured to detect a condition in which the movable track is located at a readjustment position disposed between the first position and the threshold position;

the secondary sensor being offset from the primary sensor along the direction of travel of the movable track;

the secondary sensor being mounted on the sensor mount in one of a first mounting position and a second mounting position; and in which the first mounting position is defined on a first seat, and in which the second mounting position is defined on a second seat.

* * * * *